US008573364B2

(12) United States Patent
Fang et al.

(10) Patent No.: US 8,573,364 B2
(45) Date of Patent: Nov. 5, 2013

(54) AUTOMATED ELEVATOR FIXTURE ADDRESSING

(75) Inventors: Ming Fang, Shanghai (CN); QingQi Wu, Shanghai (CN)

(73) Assignee: Otis Elevator Company, Farmington, CT (US)

( * ) Notice: Subject to any disclaimer, the term of this patent is extended or adjusted under 35 U.S.C. 154(b) by 341 days.

(21) Appl. No.: 13/055,498

(22) PCT Filed: Aug. 29, 2008

(86) PCT No.: PCT/US2008/074708
§ 371 (c)(1),
(2), (4) Date: Jan. 24, 2011

(87) PCT Pub. No.: WO2010/024815
PCT Pub. Date: Mar. 4, 2010

(65) Prior Publication Data

US 2011/0120808 A1 May 26, 2011

(51) Int. Cl.
*B66B 1/28* (2006.01)

(52) U.S. Cl.
USPC ..... 187/247; 187/391

(58) Field of Classification Search
USPC ..... 187/247, 248, 380–388, 391–393
See application file for complete search history.

(56) References Cited

U.S. PATENT DOCUMENTS

| | | | | |
|---|---|---|---|---|
| 4,193,478 | A * | 3/1980 | Keller et al. | 187/247 |
| 5,502,818 | A | 3/1996 | Lamberg | |
| 5,654,531 | A * | 8/1997 | Farabee et al. | 187/247 |
| 5,892,189 | A * | 4/1999 | Wang | 187/247 |
| 5,914,957 | A | 6/1999 | Dean et al. | |
| 6,471,011 | B1 * | 10/2002 | Ando et al. | 187/247 |
| 6,672,429 | B1 * | 1/2004 | Thurmond, III | 187/247 |
| 7,228,363 | B1 | 6/2007 | Wehrle et al. | |
| 7,699,143 | B2 * | 4/2010 | Tschuemperlin et al. | 187/394 |
| 8,177,031 | B2 * | 5/2012 | Flynn et al. | 187/247 |
| 8,342,292 | B2 * | 1/2013 | Demma | 187/247 |
| 2007/0246306 | A1 | 10/2007 | Tschuemperlin et al. | |
| 2011/0120813 | A1 * | 5/2011 | Flynn et al. | 187/384 |

FOREIGN PATENT DOCUMENTS

| | | |
|---|---|---|
| JP | 4280781 A | 10/1992 |
| WO | 0034170 | 6/2000 |

OTHER PUBLICATIONS

International Preliminary Report on Patentability for International application No. PCT/US2008/074708 mailed Mar. 10, 2011.
International Search Report and Written Opinion of the International Searching Authority for International application No. PCT/US2008/074708 mailed Jun. 5, 2009.

* cited by examiner

*Primary Examiner* — Anthony Salata
(74) *Attorney, Agent, or Firm* — Carlson, Gaskey & Olds

(57) ABSTRACT

An exemplary method of automatically addressing a plurality of fixtures in an elevator system includes establishing a shared communication link between a central controller and the plurality of fixtures. The method includes determining whether a selected elevator device operation is performed at a location of a fixture and enabling the corresponding fixture to receive initializing information, such as addressing information. The central controller broadcasts the initializing information over the communication link for automatically providing the initializing information to the enabled, corresponding fixture. By enabling only one fixture at a time, based on the selected elevator device operation, the central controller is able to accurately address each of the fixtures individually even though the initializing information is broadcast over the shared link.

20 Claims, 2 Drawing Sheets

AUTOMATED ELEVATOR FIXTURE ADDRESSING

BACKGROUND

Elevator systems include an elevator car that moves vertically to carry passengers, cargo or both to various levels within a building or structure. There are different arrangements for allowing passengers to request elevator service. One or more service call fixtures are strategically located to allow passengers to place their service requests. Some service call fixtures are considered hall call fixtures and are typically located near a hoistway door that provides access to an elevator car. Hall call fixtures typically have up and down selection buttons that allow an individual to indicate a desire to travel to another level above or below the level at which the hall call fixture is located. Other service call fixtures, such as destination entry devices, allow an individual to input information such as a desired floor level in a building to which the individual desires to travel.

Regardless of the type of fixture that is employed, it is necessary to facilitate accurate communications between the fixtures and an elevator system controller that is responsible for determining, among other things, the particular fixture (e.g., location) from which a service call is placed. Without knowing which fixture is used to make a service request, it is typically not possible to provide an expected quality of elevator service.

The typical approach to informing a controller about the particular fixtures includes providing unique addresses to each fixture. By recognizing an assigned address, the controller is able to determine from which fixture a service call was placed and to arrange for elevator service, accordingly.

Typical addressing procedures are time-consuming, labor-intensive and prone to installer error. Typical addressing occurs during elevator system installation. An installer has to manually set or configure each fixture to provide it with a unique address according to a predetermined pattern that will be recognizable by the controller. For example, an installer has to manually set a plurality of addressing switches or to manually set jumpers (e.g., wire loops) to set an address for each fixture. That process is time consuming and includes significant opportunity for installer error. If any error is made, the controller will not be able to recognize all of the fixtures as planned. Unfortunately, an installer typically cannot determine whether an error was made until the entire system is powered up and the controller fails to initialize operation of the system because of such an error. Determining which of the fixtures has been set wrong can be very difficult. Such a debugging process introduces additional time, labor and expense into an elevator system installation process.

One suggestion for automating such a process is made in U.S. Pat. No. 5,914,957. In that document a master controller communicates with a series of nodes to automatically provide address information to the nodes in sequential fashion.

SUMMARY

An exemplary method of automatically addressing a plurality of fixtures in an elevator system includes determining whether a selected elevator device operation is performed at a location of a fixture and automatically providing initializing information to the corresponding fixture responsive to the selected operation.

In one example, the selected elevator device operation comprises stopping an elevator car at a landing where the fixture is located. Another example includes opening an elevator door at the landing where the fixture is located. Another example elevator device operation comprises manually manipulating at least one switch on the fixture for at least a prescribed amount of time.

An exemplary assembly for use in an elevator system includes a controller and a plurality of fixtures. A communication link allows for communication between the controller and each of the plurality of fixtures. The controller provides initialization signals over the communication link. The fixtures are individually, automatically addressed responsive to the controller determining that a selected elevator device operation is performed at a location of each fixture, respectively.

The various features and advantages of the disclosed examples will become apparent to those skilled in the art from the following detailed description. The drawings that accompany the detailed description can be briefly described as follows.

DETAILED DESCRIPTION

Figure 1:
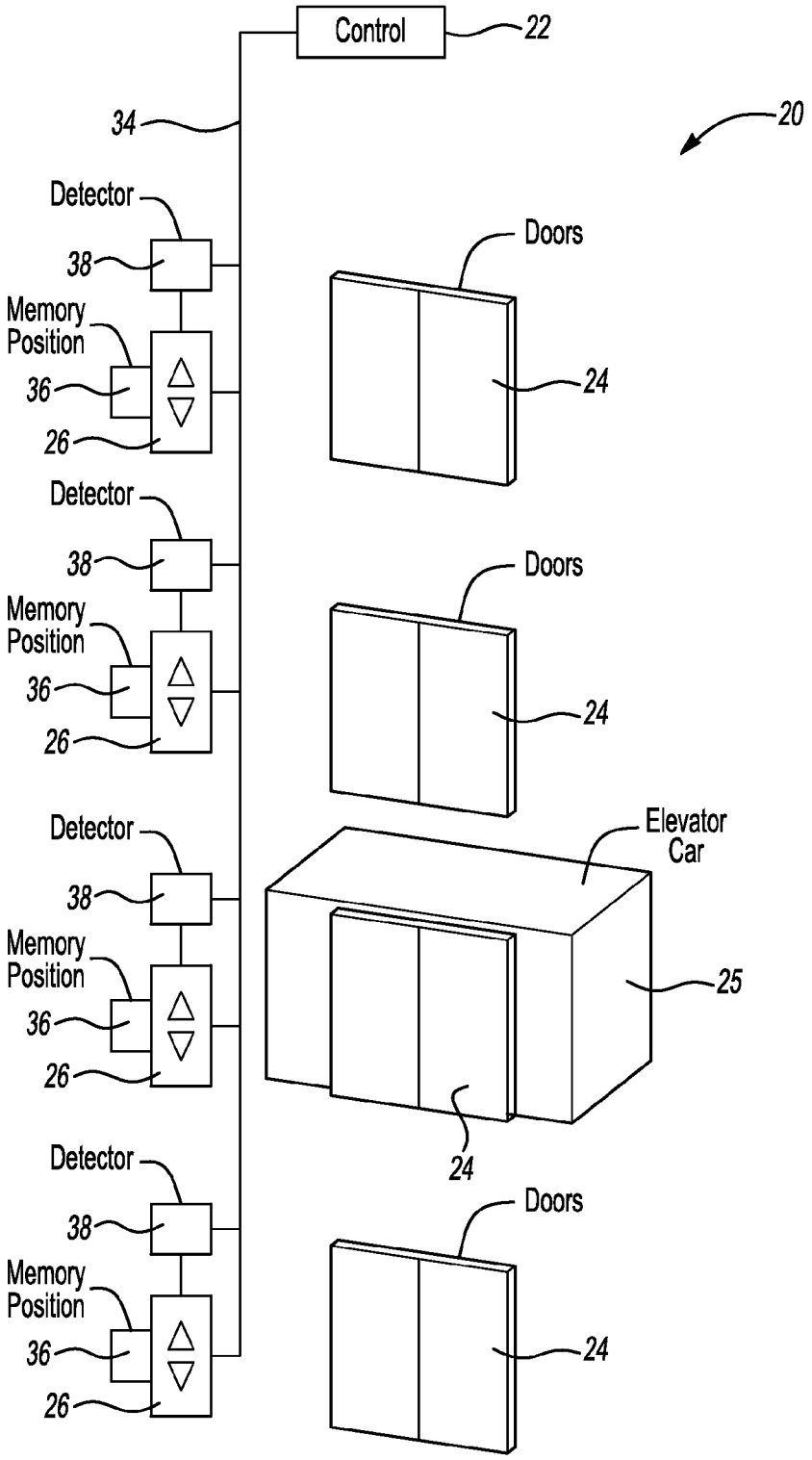
FIG. 1 schematically illustrates selected portions of an example assembly for use in an example elevator system.

FIG. 1 schematically illustrates an assembly 20 that is useful in an elevator system. The assembly 20 includes a controller 22 that is responsible for selected functions of elevator system operation. The illustration shows a plurality of hoistway doors 24 that provide access to an elevator car 25 in a known manner. The illustrated example includes a plurality of fixtures 26 that allow an individual to request elevator service.

In one example, the fixtures 26 comprise hall call fixtures that allow an individual to indicate a desire to travel to another level above or below the level at which the service call is placed. Example hall call fixtures include up and down switches (e.g., physical buttons or images on a touch screen) that can be pressed to indicate a desired direction of travel. Another example includes fixtures 26 that each comprises a destination entry device having one or more switches to allow an individual to provide an indication of a desired travel destination from outside of an elevator car. Still another example includes some fixtures 26 that comprise hall call fixtures and others that comprise destination entry fixtures.

Regardless of the type of fixture 26, the controller 22 is responsible for at least determining which of the fixtures has been accessed by an individual to indicate an elevator service request. The controller 22 uses addresses assigned to each of the fixtures 26, respectively, to determine which of the fixtures 26 was used for placing a service request. For example, once properly configured with an address, each fixture's address is recognizable in association with a service request signal so the controller 22 can determine from where the request originated.

The example of FIG. 1 includes a communication link 34 between the controller 22 and the fixtures 26. In one example, the communication link comprises a hard-wired connection between the controller 22 and the fixtures 26. One example communication link 34 comprises a communication bus such as a known CANH or a CANL bus line. Another example communication link 34 comprises at least one wireless link that facilitates wireless communications between the controller 22 and the fixtures 26. Some examples include a combination of line-based and wireless links.

Each of the example fixtures 26 includes a memory portion 36 for storing addressing information. In one example, the memory portion 36 is a programmable memory portion that initially does not contain address information and it must be enabled to receive initializing information from the controller 22.

In one example, the controller 22 generates and transmits or broadcasts initializing information over the communication link 34 when one of the fixtures 26 has a memory portion 36 enabled for receiving initializing information. In this example, only one memory portion 36 is enabled at a given time so that the initializing information will be uniquely assigned to one of the fixtures 26 for purposes of addressing that fixture to then be recognizable by the controller 22.

In the illustrated example, a fixture memory portion 36 is enabled for addressing responsive to a selected elevator device operation being performed at a location of the corresponding fixture 26. The example of FIG. 1 includes a detector 38 for detecting the selected elevator device operation at the location of the corresponding fixture 26. The detector 38 may be an integral part of a fixture 26 or may be a separate device, depending on the needs of a particular situation.

In one example, one of the fixtures 26 provides an indication to the controller 22 that it is enabled to receive addressing information responsive to the selected elevator device operation being performed at the corresponding location. In another example, the detector 38 provides a signal to the controller 22 regarding the detected elevator device operation. In another example, the controller 22 automatically makes a determination when the selected elevator device operation has been performed based on information available to the controller 22 and each of the fixtures 26 is able to determine when that elevator device operation has occurred at the location of the corresponding fixtures so that the correct fixture 26 is prepared to receive address information.

In one example, the elevator car 25 stopping at a landing during a training run is interpreted by the controller 22 as an indication to broadcast initializing information. The fixture 26 at the corresponding landing in one example includes an ability to detect the presence of the elevator car during the training run. That fixture responsively prepares to receive the initializing information into its memory portion 36.

In another example, the controller determines that the elevator car 25 has stopped at a landing during a training run and responsively broadcasts the initializing information. The fixture 26 is enabled to receive the initializing information responsive to a door switch movement at the landing as the elevator doors at that landing open or one of the switches of the fixture 26 being activated.

Figure 2:
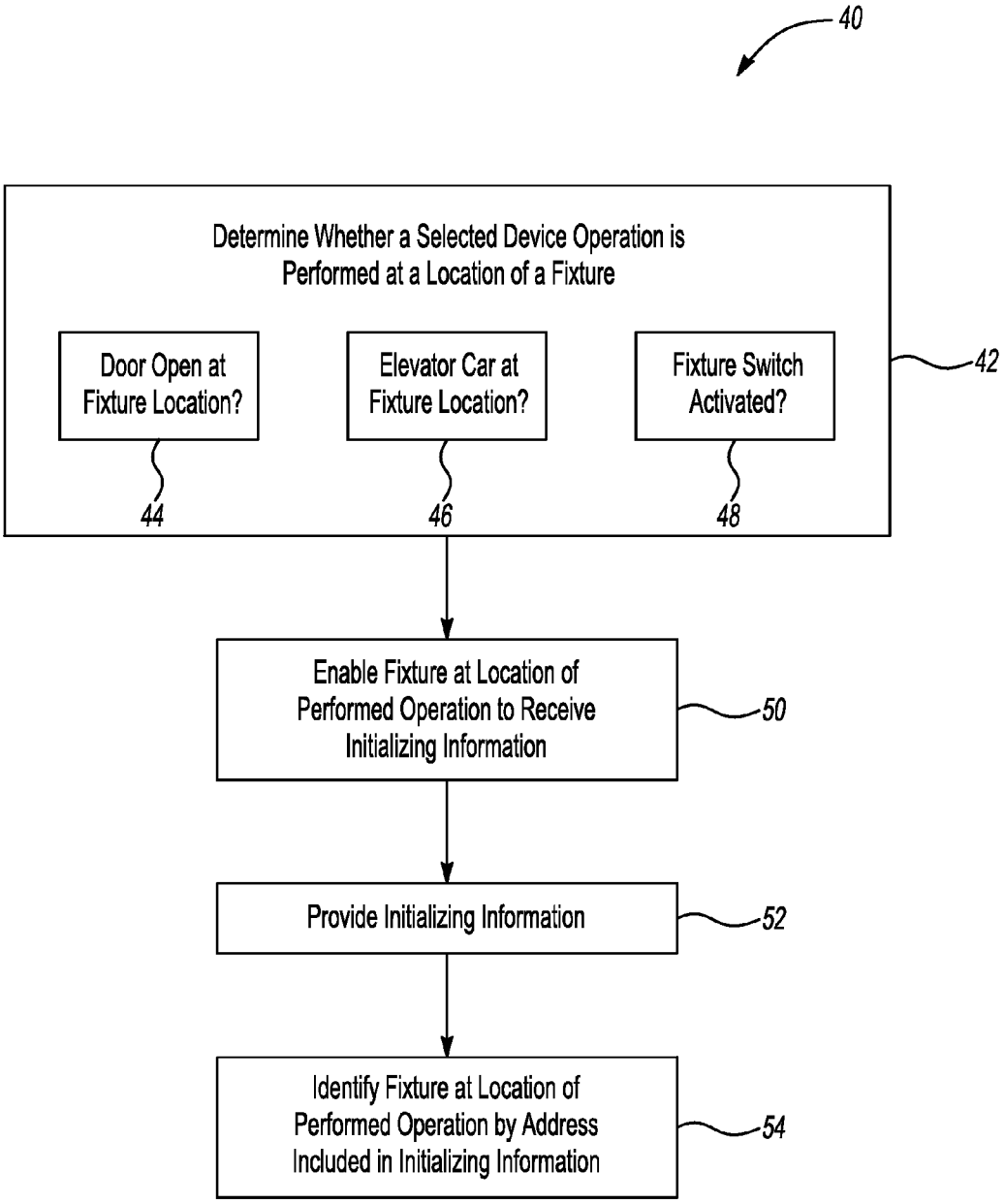
FIG. 2 is a flow chart diagram summarizing one example approach for automatically addressing an example plurality of fixtures such as those shown in FIG. 1.

FIG. 2 includes a flowchart diagram 40 summarizing one example approach. At 42, a determination is made whether a selected device operation is performed at a location of one of the fixtures 26. In this example, there are three different possible elevator device operations that are used for enabling a corresponding memory portion 36 of a fixture 26 at the appropriate location for receiving addressing information.

One example elevator device operation comprises opening one of the doors 24 at the location (e.g., the landing) of one of the fixtures 26. This determination is made at 44 in FIG. 2. For example, a detector 38 may use an indication from a hoistway door lock regarding an open condition of corresponding hoistway doors 24. There are known techniques for determining when an elevator hoistway door or elevator car door is open. Such techniques are used in one example.

Another example elevator device operation comprises stopping the elevator car 25 at the location of one of the fixtures 26 (e.g., at the corresponding landing). The determination whether an elevator car is stopped in this manner is made at 46 in FIG. 2. Determining a location of the elevator car may be accomplished by the controller 22, a corresponding one of the fixtures 26, one of the detectors 38 or a combination of these. Known elevator car position determination techniques are used in one example. Based on the location of the elevator car 25 under such circumstances, the appropriate fixture 26 can be prepared for addressing.

Another example elevator device operation comprises activating a switch of one of the fixtures 26 for at least a preselected period of time. For example, continuously pressing on a button or touch screen at one of the fixtures 26 is considered to be an elevator device operation used as a trigger for an addressing operation. In such an example, the corresponding fixture 26 provides a signal to the controller 22 indicating such a switch activation.

As shown at 50 in FIG. 2, the one of the fixtures 26 at the location of the performed operation is enabled to receive initializing information. In one example, this comprises configuring the memory portion so that it is capable of receiving initializing information including address information from the controller 22 over the communication link 34.

At 52, the controller 22 provides initializing information. In one example, the controller 22 broadcasts such information over the communication link 34. As only one of the fixtures 26 is enabled for receiving addressing information at any given time, only one of the fixtures 26 will be initialized and addressed based on the provided initializing information.

At 54, the controller identifies the fixture 26 at the location of the performed operation (i.e., the fixture having the memory portion 36 enabled for addressing). The controller 22 associates the address included in the initializing information with the corresponding one of the fixtures 26 for purposes of later identifying any signals received from that fixture 26.

Any one of the example elevator device operations may be performed at a location of one of the fixtures 26 for purposes of initializing and addressing that fixture 26. Once a fixture is addressed, the selected elevator device operation can be performed at the location of another one of the fixtures 26. Such a procedure can be repeated until all of the fixtures have been addressed.

In one example, at least one of the elevator device operations must be performed at a location of a fixture 26 for purposes of initializing and addressing that fixture. In another example, a combination of elevator device operations must be performed before the corresponding fixture 26 will be enabled for initializing and addressing. The controller 22 is programmed to recognize when a selected device operation or combination of operations has been performed. The controller 22 can broadcast the initializing information over the communication link 34 so that it will be received by the appropriate fixture 26, which has a memory portion 36 enabled for initializing and addressing.

In one example, a technician controls the ordering of the locations at which the selected elevator device operation is performed. For example, a technician may activate a fixture switch at the lowest floor as the first addressed location and then proceed, floor-by-floor, to the top floor, in order. Alternatively, a technician may begin by controlling the selected elevator device operation to occur first at the highest floor of the building and proceed, in order, to the lowest floor. Taking such an approach and suitably programming the controller 22 allows for identifying the location of each addressed fixture 26.

One feature of the disclosed examples is that they eliminate the need for manual, tedious addressing procedures for accurately and successfully installing an elevator system. The disclosed examples also eliminate the possibility for installer error of the type that requires troubleshooting and debugging analysis to discover which of the fixtures has been installed in error. In one example, the controller 22 determines whether a complete addressing procedure involving all of the fixtures 26 is complete. In the event of an error, the controller 22 is capable of providing an indication of which fixtures are correctly addressed, which are not or both to facilitate any corrective action required by an installer or technician.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of automatically addressing a plurality of fixtures in an elevator system, comprising the steps of:

establishing a shared communication link between a controller and the plurality of fixtures:

determining whether a selected elevator device operation is performed at a location of one of the fixtures, the selected elevator device operation comprising at least one of (i) stopping an elevator car at a landing corresponding to the location of one of the fixtures, (ii) opening an elevator door at a landing corresponding to the location of one of the fixtures or (iii) manually manipulating a switch of the one of the fixtures for at least a prescribed amount of time;

enabling only the one of the fixtures at the location of the determined elevator device operation for receiving initializing information;

broadcasting the initializing information from the controller over the shared communication link; and initializing only the enabled one of the fixtures responsive to the broadcast initializing information.

2. The method of claim 1, comprising subsequently performing the selected device operation at a second location of a second one of the fixtures;

determining that the subsequently performed device operation was performed at the second location;

enabling only the second one of the fixtures to receive the initializing information based on the subsequently performed device operation being performed;

broadcasting second initializing information from the controller over the shared communication link; and initializing only the enabled second one of the fixtures responsive to the broadcast second initializing information.

3. The method of claim 1, comprising performing the selected elevator device operation at a location of a different one of the fixtures subsequent to automatically providing the initializing information to the one of the fixtures; and automatically providing initializing information to the different one of the fixtures responsive to the performed operation at the location of the different one of the fixtures.

4. The method of claim 3, comprising repeating the performing and automatically providing at each of the fixtures, respectively, until all of the fixtures are addressed.

5. The method of claim 1, wherein each of the fixtures comprises a service call fixture configured to allow a passenger to request elevator service and each of the fixtures is coupled to a communication link for receiving the corresponding initializing information.

6. The method of claim 5, wherein at least one of the fixtures comprises a hall call device.

7. The method of claim 5, wherein at least one of the fixtures comprises a destination entry device.

8. An assembly for use in an elevator system, comprising a controller;

a plurality of fixtures;

a shared communication link between the controller and the plurality of fixtures, the controller determining that a selected elevator device operation is performed at a location of one of the fixtures and responsively broadcasts initializing information over the communication link, the plurality of fixtures being configured to be enabled individually for receiving the broadcast initializing information only after the selected operation is performed at the location of each fixture, respectively, the broadcast initializing information being effective to initialize only one of the fixtures that is enabled at a time when the initializing information is broadcast over the shared link, the selected elevator device operation comprising at least one of (i) stopping an elevator car at a landing corresponding to the location of one of the fixtures, (ii) opening an elevator door at a landing corresponding to the location of one of the fixtures or (iii) manually manipulating a switch of the one of the fixtures for at least a prescribed amount of time.

9. The assembly of claim 8, wherein the fixtures comprise service call fixtures configured to allow a passenger to request elevator service.

10. The assembly of claim 9, wherein at least one of the fixtures comprises a hall call device.

11. The assembly of claim 9, wherein at least one of the fixtures comprises a destination entry device.

12. The assembly of claim 8, comprising a detector at the location of each of the fixtures for detecting whether the selected operation is performed, the detector providing an indication to the controller responsive to detecting the selected operation at the corresponding location.

13. The assembly of claim 8, wherein the plurality of fixtures are arranged at differing distances from the controller and the fixtures are sequentially, automatically addressed in an order progressing from the one of the fixtures closest to the controller to the one of the fixtures furthest from the controller.

14. The assembly of claim 8, wherein the shared communication link comprises communication bus.

15. The assembly of claim 14, wherein the shared communication link comprises at least one of a CANH or a CANL bus line.

16. The assembly of claim 8, wherein the shared communication link comprises a wireless communication link.

17. The assembly of claim 8, wherein the selected device operation is subsequently performed at a second location of a second one of the fixtures;

the second one of the fixtures determines that the subsequently performed device operation was performed at the second location;

only the second one of the fixtures is enabled to receive the initializing information based on the subsequently performed device operation being performed;

the controller broadcasts second initializing information over the shared communication link; and only the enabled second one of the fixtures is initialized responsive to the broadcast second initializing information.

18. The method of claim 1, wherein the shared communication link comprises a wireless communication link.

19. The method of claim 1, wherein the shared communication link comprises a communication bus.

20. The method of claim 19, wherein the shared communication link comprises at least one of a CANH or a CANL bus line.

* * * * *